US005622445A

United States Patent [19]

Gou

[11] Patent Number: 5,622,445

[45] Date of Patent: Apr. 22, 1997

[54] DEVICE FOR CONNECTING WOODEN HANDLE AND BLADE OF A GARDENING TOOL

[76] Inventor: Fu-Chi Gou, No. 20, Lane 363, Fu-Chien Rd., Fu-Shin Hsian, Chang-Hua Hsien, Taiwan

[21] Appl. No.: 540,954

[22] Filed: Oct. 11, 1995

[51] Int. Cl.[6] ..... B25G 3/26

[52] U.S. Cl. ..... 403/375; 403/365; 403/354; 30/344

[58] Field of Search ..... 403/192, 354, 403/365, 375, 254, 292, 24, 309, 310, 311; 192/371, 372, 375; 30/344, 342, 254, 340, 341, 194, 244

[56] References Cited

U.S. PATENT DOCUMENTS

| | | | |
|---|---|---|---|
| 46,304 | 2/1865 | Miles | 30/342 |
| 997,683 | 7/1911 | Lutz, Jr. | 30/342 |
| 1,457,606 | 6/1923 | Schlehr | 30/342 |
| 2,529,618 | 11/1950 | Slavsky et al. | 30/344 |
| 3,018,497 | 1/1962 | Echikson | 30/344 X |
| 3,055,107 | 9/1962 | Carlberg | 30/341 X |
| 3,201,869 | 8/1965 | Gambino | 30/342 |

FOREIGN PATENT DOCUMENTS

| | | | |
|---|---|---|---|
| 544742 | 7/1922 | France | 30/342 |
| 651755 | 2/1929 | France | 403/365 |
| 1105832 | 7/1955 | France | 30/342 |
| 1010866 | 6/1987 | Germany | 30/342 |
| 5212162 | 8/1993 | Japan | 30/342 |
| 281047 | 12/1927 | United Kingdom | 30/340 |

*Primary Examiner*—Harry C. Kim
*Attorney, Agent, or Firm*—Browdy and Neimark

[57] ABSTRACT

A device for fastening a wooden handle and a blade of a gardening tool comprises a connection member engageable with the wooden handle and the blade. The connection member is composed of two inner frame pieces, four outer frame pieces, and a connection space formed by two inner frame pieces for receiving therein a connection end of the blade. The wooden handle is provided at one end thereof with a connection slot dimensioned to receive therein two inner frame pieces of the connection member. The connection member is engaged with the wooden handle and the blade of the gardening tool such that two inner frame pieces are lodged in the connection slot, and that four outer frame pieces embrace securely the walls of the connection slot, and further that the connection end of the blade is held securely in the connection space formed by two inner frame pieces of the connection member.

10 Claims, 2 Drawing Sheets

DEVICE FOR CONNECTING WOODEN HANDLE AND BLADE OF A GARDENING TOOL

FIELD OF THE INVENTION

The present invention relates generally to a gardening tool, and more particularly to a device for connecting a wooden handle and a blade of the gardening tool.

BACKGROUND OF THE INVENTION

The conventional gardening tools, such as shears, spade, rake, hoe, etc., are generally provided with a wooden or iron tube handle. The wooden handle of the gardening tools is defective in design in that the dimension of the connection end of the wooden handle must be large enough to be drilled a connection hole for fastening the blade of the gardening tool. If the dimension of the connection end of the wooden handle is too small, the connection end is likely cracked when it is drilled the connection hole. In addition the wooden handle must be round in its cross section. Therefore, the wooden handle is relatively expensive in view of the fact that the wooden handle must be turned additionally. The turning of the wooden rods results in the waste of the timber resource.

SUMMARY OF THE INVENTION

It is therefore the primary objective of the present invention to provide a gardening tool with a wooden handle which can be made easily and economically.

It is another objective of the present invention to provide a gardening tool with a wooden handle which is non-circular in its cross section and is provided with a connection end capable of holding securely the blade of the gardening tool.

It is still another objective of the present invention to provide a gardening tool with a wooden handle which is so made as to reduce the consumption of our limited timber resource.

The foregoing objectives of the present invention are attained by a wooden handle of the gardening tool, which is rectangular in its cross section and is provided peripherally with two accuate surfaces. The wooden handle is further provided centrally at the connection end thereof with a slot extending in the direction of the longitudinal axis of the wooden handle. The slot is so dimensioned as to accommodate therein a connection member which is made up of two inner frame pieces parallel to each other and of four outer frame pieces. The connection member is engaged with the slot such that two inner frame pieces are secured in the slot and that four outer frame pieces embrace the outer sides of the slot walls. Two inner frame pieces form therebetween a connection space for holding therein a connection end of the cutting blade of the gardening tool.

The foregoing objectives, features and advantages of the present invention will be more readily understood upon a thougthful deliberation of the following detailed description of the present invention in conjunction with the accompanying drawings.

DETAILED DESCRIPTION OF THE INVENTION

Figure 1:
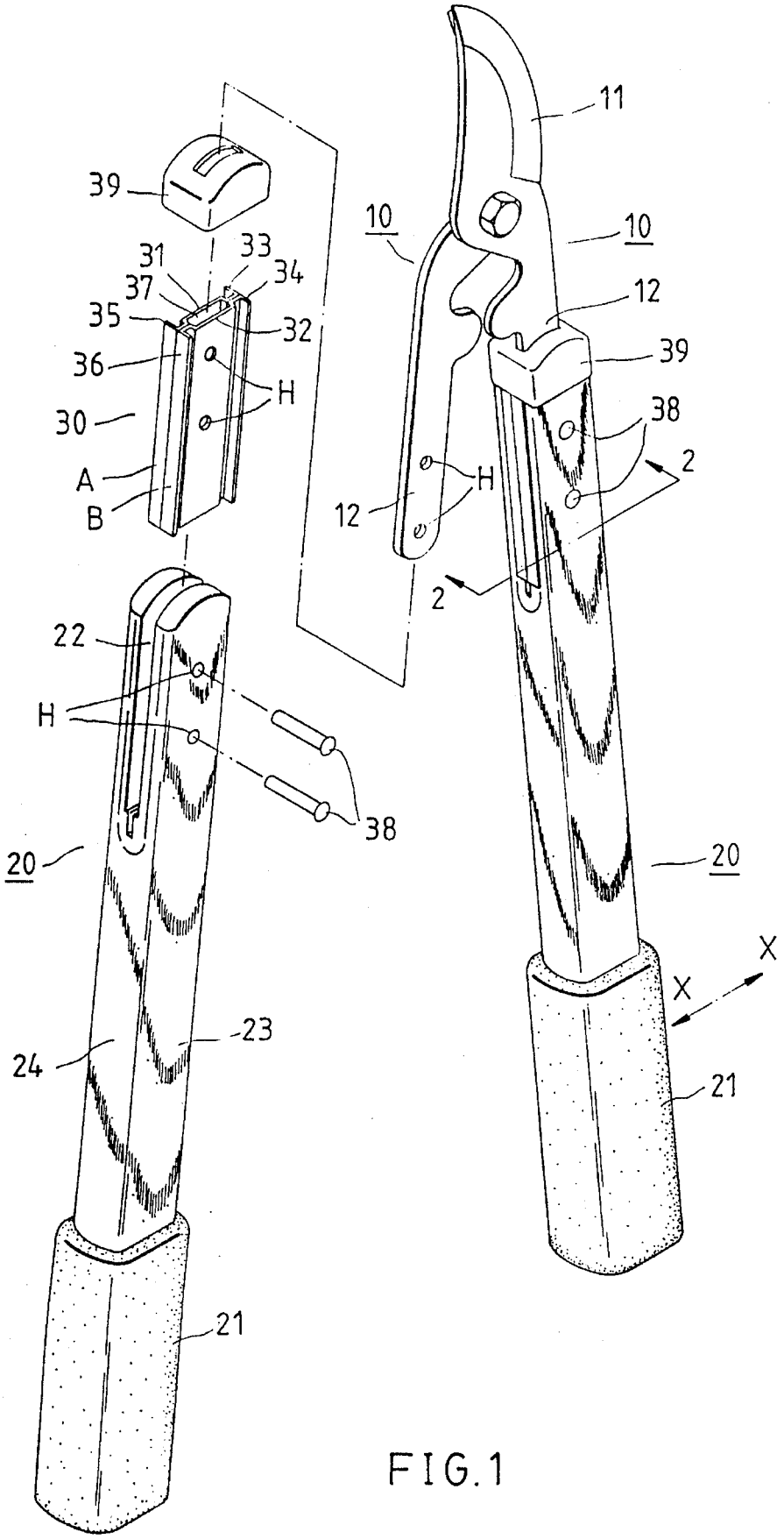
FIG. 1 shows a partial exploded view of a first preferred embodiment of the present invention.
Figure 2:
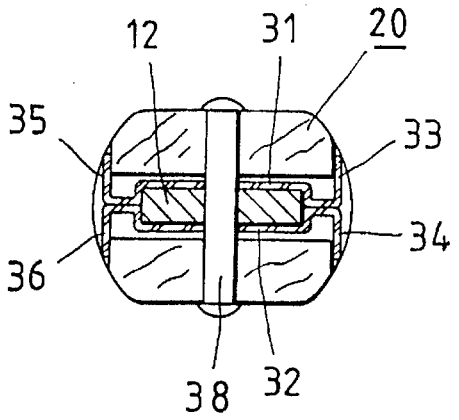
FIG. 2 shows an enlarged sectional view of a portion taken along the direction indicated by the line 2—2 as shown in FIG. 1.

As shown in FIGS. 1 and 2, a gardening tool of the present invention comprises two blades 10 and two wooden handles 20. The blades 10 have respectively a cutting edge 11 and a connection portion 12. The wooden handle 20 has a rectangular cross section and is provided at the posterior end (which is the end away from the blades) thereof with a grip 21. The wooden handle 20 is further provided at the anterior end (that is the end close to the blades) thereof with a connection slot 22. The wooden handle 20 is provided peripherally with two planar surfaces 23 opposite to each other and with two arcuate surfaces 24. The blade 10 and the handle 20 are fastened by a connection member 30 which is made up of two metal plates A and B, two inner frame pieces 31 and 32, and four outer frame pieces 33, 34, 35 and 36. The connection member 30 has a cross section with a configuration of II. The inner frame pieces 31 and 32 are corresponding in width to the slot 22 and are lodged securely in the slot 22. In other words, the connection member 30 is engaged with the slot 22 such that two inner frame pieces 31 and 32 are secured in the slot 22 and that four outer frames 33, 34, 35 and 36 embrace securely the outer sides of the walls of the slot 22. Two inner frame pieces 31 and 32 form therebetween a connection space 37 dimensioned to receive therein the connection portion 12 of the blade 10. The connection portion 12 is held securely in the connection space 37 by means of two rivets 38 (also herein termed transverse fasteners) engageable with the through holes H. The connection member 30 is provided with a cap 39 of a metal or plastic material for strengthening the connection member 30 and enhancing the esthetic effect of the connection member 30.

It is readily apparent that the blade 10 and the wooden handle 20 are held together securely by the connection member 30 which is engaged with the slot 22 of the wooden handle 20. The wooden handle 20 is capable of sustaining a greater pressure exerting thereon, thanks to the outer frame pieces 33, 34, 35 and 36 of the connection member 30. In addition, the wooden handle 20 can be easily fastened with the blade 10.

The greater pressure due to bending force between the handle 20 and the blade 10 results from the handles 20 being pushed together at the grips 21, which causes the two blades 10 to rotate about the bolt (un-numbered) which is disposed between the cutting portions of the blade (adjacent the cutting edges 11) and the connection portions 12, herein also denoted as a tang. The bolt acts as a pivot for the relative blade rotation of shearing cuts.

Figure 3:
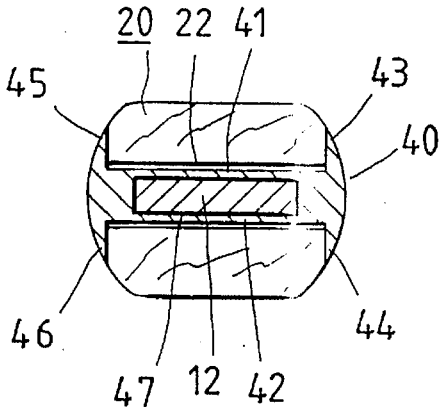
FIG. 3 shows an enlarged sectional view of a portion of a second preferred embodiment of the present invention, with the portion being taken in a way similar to that of FIG. 2.

As shown in FIG. 3, a second preferred embodiment of the present invention is different from the first preferred embodiment of the present invention in that the former is provided with a connection member 40 which is made integrally of a metal or plastic material. The connection member 40 comprises two inner frame pieces 41 and 42, four outer frame pieces 43, 44, 45 and 46, and a connection space 47. The way by which the blade 10 and the wooden handle 20 are fastened together by the connection member 40 is similar to that of the first preferred embodiment described above.

Figure 4:
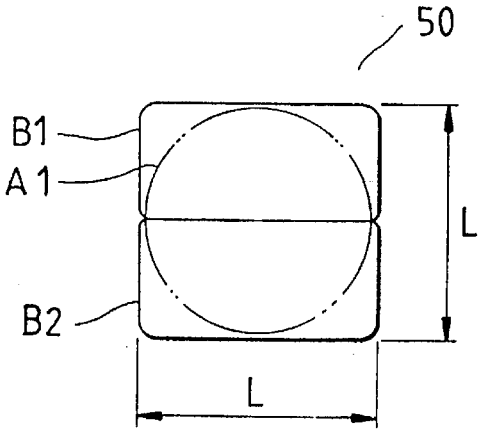
FIG. 4 is a schematic view illustrating that a wooden rod for making one conventional wooden handle can be used to make two wooden handles of the present invention.

As illustrated in FIG. 4, the conventional wooden handle A1 is made of an L×L wooden rod 50 by turning. The wooden handle A1 has a diameter slightly smaller than L. On the other hand, the wooden rod 50 can be used to make two wooden handles 20 of the present invention in view of the fact that the wooden rod 50 can be split into two wooden rods B1 and B2, which have respectively a rectangular cross section. Two wooden handles 20 of the present invention are made of two wooden rods B1 and B2. As a result, each of two wooden handles 20 has an L thickness enabling the wooden handle 20 to sustain effectively the pressure exerting thereon along the direction of the longitudinal axis of the wooden handle 20. In other words, the structural strength of the wooden handle 20 of the present invention is not compromised.

To sum up, the present invention can increase the utilization rate of the wooden material so as to conserve the timber resources. In addition, the wooden handles of the present invention can be made easily and economically without a turning process. The blade and the wooden handle of the present invention are fastened securely by the connection member. Moreover, the wooden handle of the present invention is provided peripherally with two planar surfaces on which words or figures can be printed easily. The wooden handle and the connection member are so matched that they give an added value to the gardening tool.

What is claimed is:

1. In a gardening tool of the type having:

two blades (10) wherein each of the blades includes a cutting portion and a generally flat tang (12);

a pivot for allowing said two blades to pivot with respect to each other:

a handle (20) having side faces and two end faces for attaching said each blade thereto, said handle including a slot (22) extending from one of said end faces and terminating at a location remote from another of said end faces and also extending from one of said side faces to another of said side faces to define a bifurcated end of the handle, wherein:

the improvement comprising:

a connection member (30, 40) including inner frame means for receiving the tang therewithin and being disposed within the slot of the handle and outer frame pieces adjoining the inner frame means for securely embracing only the side faces of the handle having the slot thereon; and at least one transverse fastener (38) extending through said handle, tang, and connection member to securely fasten the tang to the handle;

whereby the connection member is adapted to transfer forces between the tang and the handle.

2. The improvement according to claim 1, wherein the connection member (30) comprises a pair of corrugated pieces, the inner frame means comprises corrugations of the corrugated pieces, and the pair of corrugated pieces are in contact between the inner frame means and the outer frame pieces on either edge of the tang.

3. The improvement according to claim 2, wherein the corrugated pieces form a cross section of a II configuration.

4. The improvement according to claim 2, wherein the corrugated pieces are symmetrical in shape to each other.

5. The improvement according to claim 4, wherein the corrugated pieces are identically shaped and a first one of the pair is symmetrical to a second one of the pair due to 180-degree rotation about an axial length of the first one.

6. The improvement according to claim 5, wherein the corrugated pieces are constant in cross section.

7. The improvement according to claim 1, wherein the connection member (40) is integral.

8. The improvement according to claim 1, wherein the handle is wooden.

9. The improvement according to claim 1, wherein the connection member includes material selected from the group consisting of metal and plastic.

10. The improvement according to claim 1, wherein the transverse fastener is a rivet.

* * * * *